United States Patent [19]

Handler et al.

[11] Patent Number: 4,572,988

[45] Date of Patent: Feb. 25, 1986

[54] HIGH FREQUENCY BALLAST CIRCUIT

[75] Inventors: Howard Handler, Westminster; Ronald L. Wilson, Anaheim, both of Calif.

[73] Assignee: Industrial Design Associates, (IDA), Newport Beach, Calif.

[21] Appl. No.: 525,229

[22] Filed: Aug. 22, 1983

[51] Int. Cl.[4] ..... H05B 37/02; H05B 39/04; H05B 41/36

[52] U.S. Cl. ..... 315/209 R; 315/DIG. 5; 315/DIG. 7; 315/240

[58] Field of Search ..... 315/DIG. 5, DIG. 7, 315/209, 240, 101, 103, 105, 106

[56] References Cited

U.S. PATENT DOCUMENTS

| | | | |
|---|---|---|---|
| Re. 29,204 | 5/1977 | Snyder | 315/106 |
| 3,476,976 | 11/1969 | Morita et al. | 315/105 X |
| 3,626,243 | 12/1971 | Koyama et al. | 315/101 |
| 3,851,209 | 11/1974 | Murakami et al. | 315/106 |
| 3,917,976 | 11/1975 | Nuckolls | 315/240 |
| 4,117,377 | 9/1978 | Jimerson et al. | 315/101 |
| 4,388,562 | 6/1983 | Josephson | 315/DIG. 7 |
| 4,415,837 | 11/1983 | Sodini | 315/DIG. 5 |
| 4,417,181 | 11/1983 | Leale | 315/209 R |

*Primary Examiner*—Saxfield Chatmon
*Attorney, Agent, or Firm*—James F. Kirk

[57] ABSTRACT

A high frequency ballast circuit is provided having first and second power input terminals and first and second power output terminals. The high frequency ballast circuit is powered by an input voltage source, such as an off-line, filtered, rectified dc voltage source. The high frequency ballast circuit has a starting mode and operating mode. The high frequency ballast circuit comprises: a power oscillator circuit having power oscillator first and second output terminals, for converting power coupled from the high frequency ballast circuit first and second power input terminals to a relatively high frequency, quasi-sinusoidal, current-limited voltage source applied between the power oscillator first and second output terminals. A starting circuit for interposing a periodic voltage pulse between the power oscillator first output terminal and the lamp load. The periodic voltage pulse is adapted to exceed the ionization potential of the lamp load during the starting mode. The starting and current limiting circuit also provides a predetermined reactance between the first power oscillator output terminal and the high frequency ballast circuit first power output terminal to limit current through the fluorescent lamp load.

In an alternative embodiment, the starting and current limiting circuit is further adapted to interrupt the periodic voltage pulse during the operating mode. In another alternative and particularly preferred embodiment, the starting and current limiting circuit uses a SIDAC device and provides start pulses to the lamp load at approximately one second intervals until the lamp load ionizes.

15 Claims, 4 Drawing Figures

HIGH FREQUENCY BALLAST CIRCUIT

BACKGROUND OF THE INVENTION

1. Field of the Invention

This invention relates to the field of fluorescent lighting and more particularly to the field of circuits designed to convert electrical power derived from low frequency single or multi-phase ac service such as sixty cycle, 115 V ac to a high frequency for driving fluorescent lamps with a limited and relatively constant sinusoidal drive current; thereby making it possible to replace the costly and heavy low frequency ballast circuit typically employed in starting and driving fluorescent lamps with a light-weight, inexpensive, highly efficient, low cost circuit. The invention circuit is particularly suited for use in driving fluorescent lamps as well as HID lamps of both the high and low pressure sodium types having ratings of 50 to 500 watts.

2. Description of the Prior Art

Some presently known high frequency ballast circuits such as that discussed in "Design of Solid-state Power Supplies" by Eugene R. Hnatek, pg 470, Van Nostrand, 1981 typically use high-Q resonant circuits in shunt with the fluorescent lamp load for the purpose of developing a voltage across the lamp sufficient in amplitude to start the lamp. Circuits of this type are sensitive to the quality and tolerance of components used in their construction. The circuit in the Hnatek reference is substantially different from the present invention circuit in that the invention ballast circuit does not form a tuned tank in parallel with the load for the purpose of developing a voltage high enough to start the lamp. The invention circuit is adapted to provides a recurrent series of start pulses to ionize and start the lamp load.

SUMMARY OF THE INVENTION

It is a major objective of this invention to provide a an efficient, compact, reliable, solid state high frequency ballast circuit for starting and operating a fluorescent as well as a HID lamp load. The invention circuit requires relatively few and relatively inexpensive parts.

It is another objective of this invention to reduce the dependence of the circuit on tightly toleranced components thereby increasing the availability of components and their respective cost.

It is a more particular objective of this invention to provide repetitive starting pulses of power of a predetermined amplitude to a fluorescent lamp load until the lamp ionizes and starts. It is another objective of the invention circuit to discontinue the application of the pulses to the fluorescent lamp load subsequent to the lamp ionizing and starting.

A particular embodiment of the invention high frequency ballast circuit that is provided has first and second power input terminals and first and second power output terminals. The high frequency ballast circuit is powered by an input voltage source of a first polarity coupled between the first and second power input terminals. The high frequency ballast circuit has a starting mode and operating mode for starting and operating a fluorescent lamp load connected between the first and second power output terminals. The starting mode is characterized by the high frequency ballast circuit operation before ionization of the fluorescent lamp load. The operating mode is characterized by the high frequency ballast circuit operation subsequent to ionization of the fluorescent lamp load.

The high frequency ballast circuit comprises: a power oscillator circuit means having power oscillator first and second output terminals for converting power coupled from the high frequency ballast circuit first and second power input terminals to a relatively high frequency, quasi-sinusioidal, current-limited voltage source applied between the power oscillator first and second output terminals. The power oscillator second output terminal is coupled to the high frequency ballast circuit second power output terminals A starting and current limiting circuit means for interposing a periodic voltage pulse between the power oscillator first output terminal and the high frequency ballast circuit first power output terminal is provided.

The periodic voltage pulse provided by the starting and current limiting circuit means has an amplitude adapted to exceed the ionization potential of the lamp load during the starting mode, the starting and current limiting circuit means additionally providing a predetermined reactance between the first power oscillator output terminal and the high frequency ballast circuit first power output terminal to limit current through the fluorescent lamp load.

In another alternative embodiment, the starting and current limiting circuit means is further adapted to interrupt the periodic voltage pulse during the operating mode.

In yet another more particular embodiment, the starting and current limiting circuit means further comprises: a transformer having a primary winding and a secondary winding. The primary winding has at least a first and second terminal, and the secondary winding has at least a first and second terminal. The transformer secondary winding first terminal is coupled to the power oscillator first output terminal and the secondary winding second terminal is coupled to the high frequency ballast circuit first power output terminal. The transformer secondary winding has a greater number of turns than the primary winding. The secondary self inductance selected to limit the fluorescent lamp load current to a predetermined limit based on the characteristics of the lamp load to be driven.

This more particular embodiment also has a capacitor with a first and second terminal; a resistor with a first and second terminal and a diode having an anode terminal and a cathode terminal. The capacitor, resistor and diode are coupled to form a first series circuit between the high frequency ballast circuit first and second power output terminals, the first series circuit having the diode rectify a portion of the relatively high frequency quasi-sinusoidal, current-limited voltage providing rectified current through the diode, the capacitor, and the resistor, the rectified current producing a positive quasi-exponentially increasing voltage on the capacitor first terminal with respect to the capacitor second terminal during the starting mode.

The threshold voltage triggered switching means has at least a first and second switch terminal for triggering and switching from a non-conductive first state to a conductive second state establishing a conductive path between the first and second switch terminal. The threshold voltage triggered switching means triggers in response to the positive quasi-exponentially increasing voltage on the capacitor first terminal with respect to the capacitor second terminal, during the starting mode, exceeding a predetermined threshold limit. The threshold voltage triggered switching means is further adapted to return to the first state in response to the the voltage between the first and second switch terminals dropping below a second predetermined threshold limit. The transformer primary winding is coupled to form a second series circuit between the first and second switch terminals. The second series circuit is coupled in shunt with the capacitor.

During the starting mode, the threshold voltage triggered switching means triggers in response to the positive quasi-exponentially increasing voltage on the capacitor first terminal with respect to the capacitor second terminal exceeding the predetermined threshold voltage. The triggered switching means applies the voltage between the capacitor terminals to the transformer primary winding. The capacitor discharges through the transformer primary winding, and the transformer operates to provide a stepped-up voltage across the transformer secondary terminals. The stepped-up voltage is selected to exceed the ionization voltage of the fluorescent lamp load.

The high frequency ballast circuit thereafter advances to the operating mode applying the relatively high frequency quasi-sinusoidal, current-limited voltage source to the fluorescent lamp load through the transformer secondary winding to operate the fluorescent lamp load.

In an even more particular alternative embodiment, the transformer primary and secondary windings alternatively comprise an autotransformer having a single winding with at least a first, second and third terminal. The first and third terminals are at opposing ends of the single winding. The transformer secondary winding is formed by the single winding between the transformer first and third terminal. The transformer first terminal is coupled to the power oscillator first output terminal. The secondary winding third terminal is coupled to the high frequency ballast circuit first power output terminal. The transformer second terminal is a tap terminal between the first and third terminals. The portion of the single winding between the second and third transformer terminals forms the transformer primary.

The first series circuit comprising the series combination of the capacitor, the resistor and the diode has the capacitor first terminal coupled to high frequency ballast circuit first power output terminal. The series combination of the resistor and the diode form a third series circuit having a first and second terminal. The capacitor second terminal is coupled to the third series circuit first terminal. The third series circuit second terminal is coupled to the high frequency ballast circuit first power output terminal.

The first switch terminal is coupled to the capacitor second terminal and the second switch terminal is coupled to the transformer second terminal. In this way, during the starting mode, the threshold voltage triggered switching means triggers in response to the positive quasi-exponentially increasing voltage on the capacitor first terminal with respect to the capacitor second terminal exceeding the predetermined threshold voltage. The triggered switching means applies the voltage across the capacitor to the transformer primary winding, the capacitor discharging through the transformer primary winding, the transformer operating to provide a stepped-up voltage across the transformer secondary terminals, the stepped-up voltage being selected to exceed the ionization voltage of the fluorescent lamp load.

BRIEF DESCRIPTION OF THE DRAWINGS

The invention will be further described as to an illustrative embodiment in conjunction with the accompanying drawings in which.

DESCRIPTION OF THE PREFERRED EMBODIMENT

Figure 1:
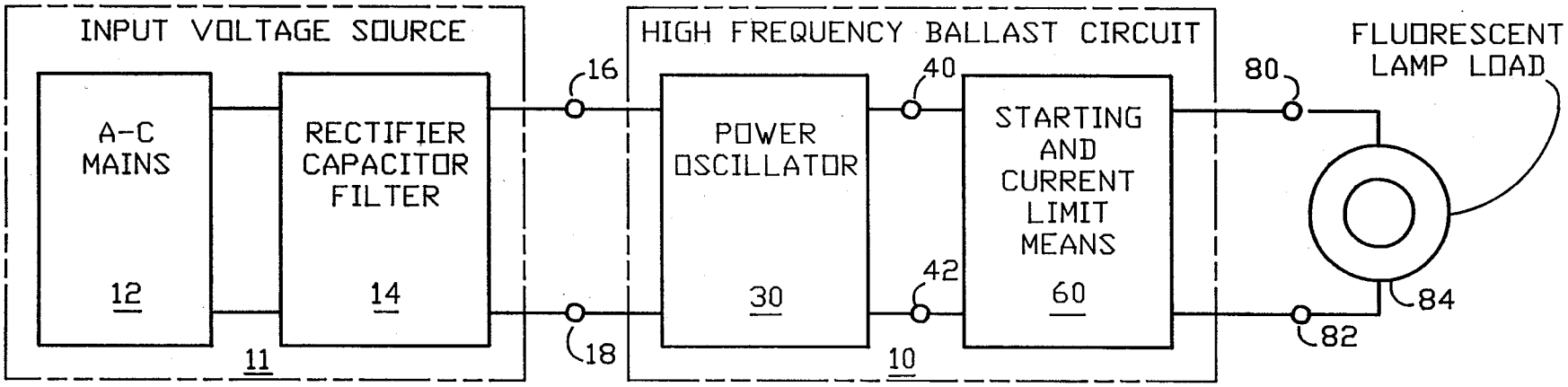
FIG. 1 is a block diagram of the invention High Frequency Ballast Circuit.

In accordance with the present invention, FIG. 1 is a block diagram of the high frequency ballast circuit 10 having first and second power input terminals 16, 18 and first and second power output terminals 80, 82. The high frequency ballast circuit is powered by an input voltage source of a first polarity such as the positive voltage source 11. This source, shown for the purpose of illustration, comprises a conventional rectifier, typically a bridge followed by a capacitor filter powered by voltage from the ac mains. The rectifier and capacitor filter are represented by block 14 and the conventional ac mains voltage source is represented by block 12. The circuit shown is particularly suited for operation off of single or multi-phase 115 V ac, or 220 Vac, 60 Hz service followed by an appropriate rectifier and filter, coupled between the first and second power input terminals 16 and 18 respectively.

The high frequency ballast circuit 10 has a starting mode and operating mode for starting and operating a fluorescent lamp load 84 connected between first and second power output terminals 80 and 82. The starting mode is characterized by the high frequency ballast circuit operation before ionization of the fluorescent lamp load and the operating mode is characterized by the high frequency ballast circuit operation subsequent to ionization of the fluorescent lamp load.

Figure 2:
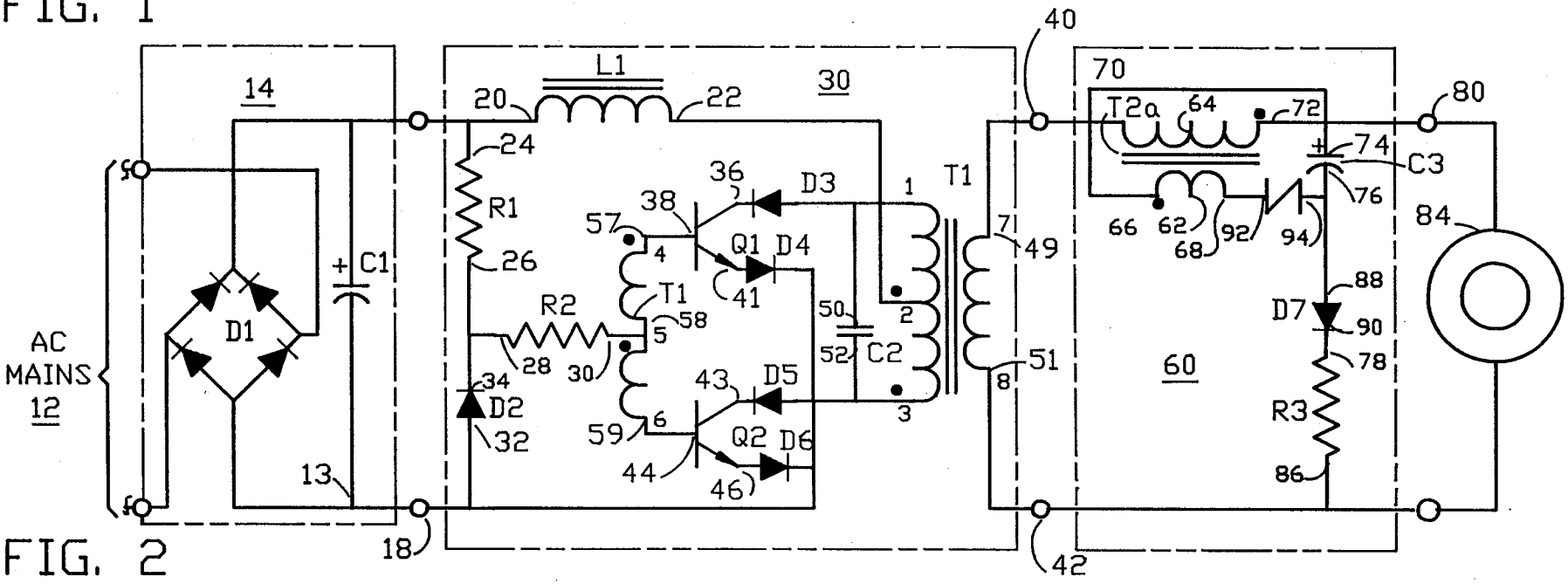
FIG. 2 is a schematic of the preferred embodiment of the invention High Frequency Ballast Circuit.

Referring now to FIG. 2, the high frequency ballast circuit 10 comprises a power oscillator circuit means such as circuit 10 having power oscillator first and second output terminals 40, 42 for converting power coupled from the high frequency ballast circuit first and second power input terminals 16 and 18 to a relatively high frequency, quasi-sinusoidal, current-limited voltage source applied between the power oscillator first and second output terminals, 40, 42. The power oscillator second output terminal 42 is coupled to the high frequency ballast circuit second power output terminal 82.

A starting and current limiting circuit means such as that represented by block 60 in FIG. 1 and more particularly by the circuitry contained within phantom block 60 of FIG. 2 is provided for interposing a periodic voltage pulse between the power oscillator first output terminal 40 and the high frequency ballast circuit first power output terminals 80. The periodic voltage pulse provided has an amplitude adapted to exceed the ionization potential of the lamp load during the starting mode. The starting and current limiting circuit means additionally provides a predetermined reactance between the first power oscillator output terminal 40 and the high frequency ballast circuit first power output terminal 80 to limit current through the fluorescent lamp load 84.

The starting and current limiting circuit means depicted by the circuitry contained within phantom block 60 of FIG. 2 is adapted to interrupt the periodic voltage pulse during the operating mode. This operational feature is dependent on the characteristics of the lamp load 84 and the selection of component values for the circuit.

A first alternative embodiment of the starting and current limiting circuit means 60 comprises: a transformer such as T2*a* having a primary winding 62 and a secondary winding 64, the primary winding 62 having at least a first and second terminal 66, 68, and the secondary winding 64 having at least a first and second terminal 70, 72. The transformer secondary winding first terminal 70 is coupled to the power oscillator first output terminal 40 and the secondary winding second terminal is coupled to the high frequency ballast circuit first power output terminal 80. The transformer secondary winding 64 has a greater number of turns than the primary winding 62 and a secondary self inductance selected to limit the fluorescent lamp load current to a predetermined limit. This alternative embodiment also has a capacitor C3 having a first and second terminal 74, 76; a resistor R3 having a first and second terminal 78, 86; a diode D7 having an anode terminal 88 and a cathode terminal 90. The capacitor C3, resistor R3 and diode D7 are coupled to form a first series circuit between the high frequency ballast circuit first and second power output terminals 80, 82. The diode D7 of the first series circuit rectifies a portion of the relatively high frequency quasi-sinusoidal, current-limited voltage applied by the power oscillator circuit 30 to the starting and current limiting circuit means 60 at the power oscillator's first and second output terminals 40, 42. The rectified current passes through the diode, the capacitor, and the resistor and produces a positive quasi-exponentially increasing voltage on the capacitor first terminal 88 with respect to the capacitor second terminal 90 during the starting mode.

A threshold voltage triggered switching means is included such as the SIDAC SD1. The threshold voltage switching means has at least a first and second switch terminal 92, 94 for triggering and switching from a nonconductive first state to a conductive second state establishing a conductive path between the first and second switch terminal 92 and 94 respectively. The threshold voltage triggered switching means operates in response to the positive quasi-exponentially increasing voltage on the capacitor first terminal 74 measured with respect to the capacitor second terminal 76 during the starting mode exceeding a predetermined threshold limit.

The threshold voltage triggered switching means, such as SIDAC SDl is further adapted to return to the first state, i.e. a non-conductive state, in response to the the voltage between the first and second switch terminals dropping below a second predetermined threshold limit.

The transformer primary winding 62 is shown coupled to form a second series circuit with the threshold voltage triggered switching means such as SD1. The second series circuit is coupled in shunt, i.e. in parallel, with the capacitor C3.

During the starting mode, the threshold voltage triggered switching means, such as SD1, triggers in response to the positive quasi-exponentially increasing voltage on the capacitor first terminal measured with respect to the capacitor second terminal exceeding the predetermined threshold voltage, i.e. the avalanche or firing voltage of the SIDAC SD1. The triggered switching means SD1 applies the voltage on the capacitor C3 to the transformer primary winding 62, the capacitor C3 discharging through the transformer primary winding 62. The transformer T2*a* operates to provide a stepped-up voltage across the transformer secondary terminals 70 and 72. The stepped-up voltage is selected to exceed the ionization voltage of the fluorescent lamp load 84. The high frequency ballast circuit thereafter advances to the operating mode in which it applies the relatively high frequency, quasi-sinusoidal, current-limited voltage source to the fluorescent lamp load 84 through the transformer secondary winding 64 to operate the fluorescent lamp load 84.

Figure 3:
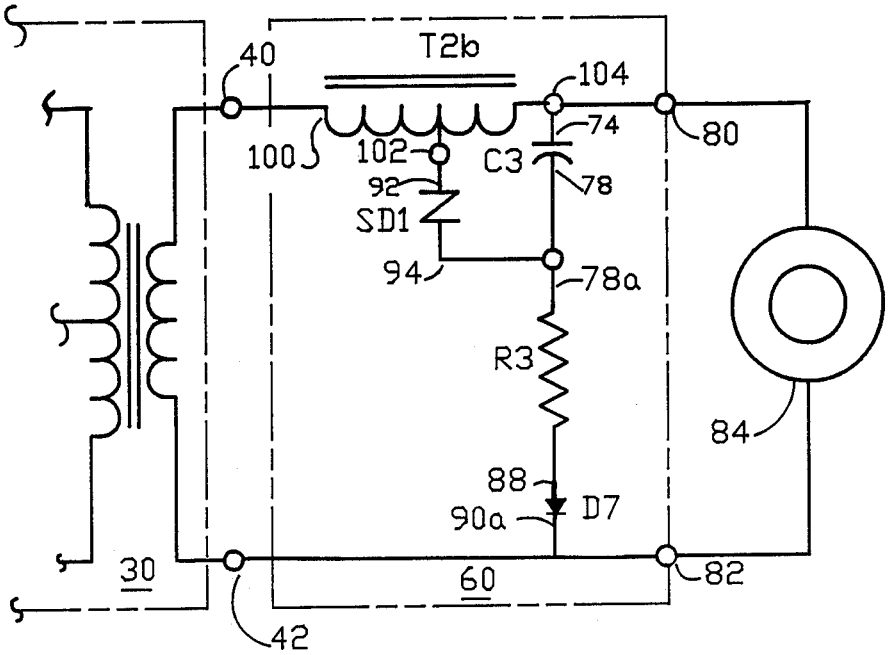
FIG. 3 is a schematic of an alternative embodiment of the invention circuit starting and current limiting circuit using an auto-transformer.

FIG. 3 depicts a second alternative embodiment of the starting and current limiting circuit means 60 in which the transformer is shown as auto-transformer T2*b* having primary and secondary windings combined into a single winding with a predetermined tap. This second alternative embodiment is shown with the simgle winding having at least a first, second and third terminal 100, 102 and 104. The first and third terminals are at opposing ends of the single winding. The transformer secondary winding is formed by the single winding between the transformer first and third terminal 100 and 104. The transformer first terminal 100 is coupled to the power oscillator first output terminal 40. The secondary winding third terminal 104 is coupled to the high frequency ballast circuit first power output terminal 80. The transformer second terminal is tap terminal 102 between transformer first and third terminals 100 and 104. The portion of the single winding between the second and third transformer terminals 102 and 104 forms the transformer primary.

The first series comprising the series combination of the capacitor C3, the resistor R3 and diode D7 has the capacitor first terminal 74 coupled to high frequency ballast circuit first power output terminal 80. The series combination of the resistor R3 and the diode D7 form a third series circuit having a first and second terminal such as 78*a* and 90*a*. The capacitor second terminal 78 is coupled to the third series circuit first terminal 78*a*. The third series circuit second terminal 90*a* is coupled to the high frequency ballast circuit first power output terminal 80. The first switch terminal 94 is coupled to the capacitor second terminal 78. The second switch terminal 92 is coupled to the the transformer second terminal 102.

During the starting mode, the threshold voltage triggered switching means such as SD1, triggers each time the quasi-exponentially increasing voltage on the capacitor first terminal 74 measured with respect to the capacitor second terminal 78 exceeds the predetermined threshold voltage or firing voltage of the SD1 or equivalent device. The triggered switching means assumes a highly conductive state thereby applying the voltage across capacitor C3 to the transformer primary winding between 102 and 104. Capacitor C3, as shown in FIG. 3, discharges through the transformer T2*b* primary winding between 102 and 104.

T2*b* thereafter operates to provide a stepped-up voltage across the transformer secondary terminals between 100 and 104. The stepped-up voltage is selected to exceed the ionization voltage of the lamp load 84. The high frequency ballast circuit thereafter advances to the operate mode and applies a relatively high-frequency, quasi-sinusoidial, i.e. nearly sinusoidal, current-limited voltage source between 40 and 42 to the fluorescent lamp load 84 through the transformer T2*b* secondary winding between 100 and 104 to operate the lamp load 84.

Figure 4:
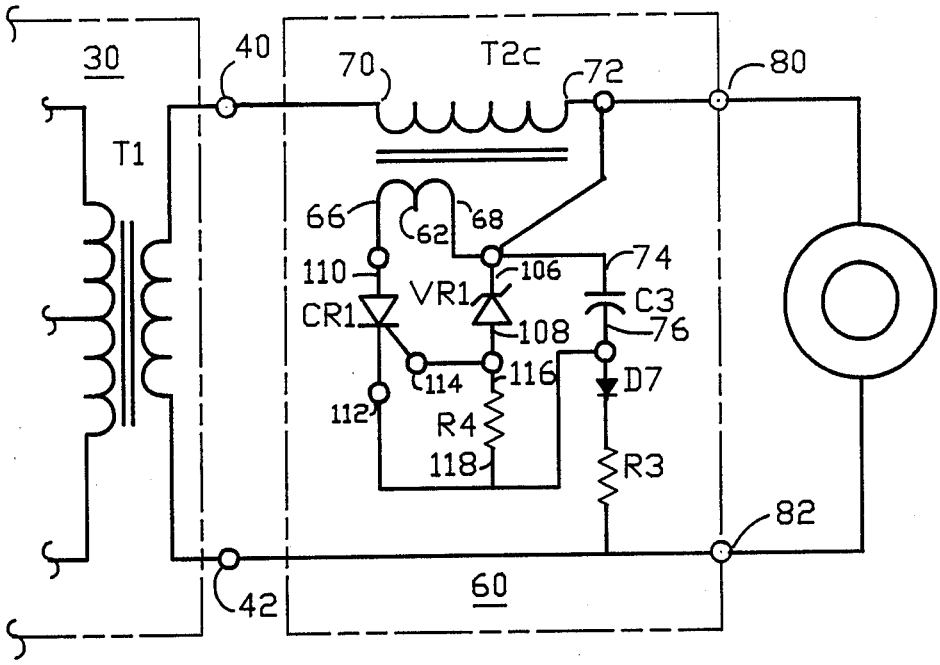
FIG. 4 is an alternative embodiment of a circuit adapted to function as a threshold voltage triggered switch means.

FIG. 4 shows a third alternative embodiment in which the threshold voltage triggered switching means includes zener diode VR1 having a cathode 106 and anode 108. The cathode 106 is coupled to the high-frequency ballast circuit first power output terminal 80. A silicon controlled rectifier CR1 is shown having anode 110, cathode 112 and gate 114. Anode 110 is coupled to the transformer T2*c* primary first terminal first terminal 66.

Resistor R4 has first and second terminals 116 and 118 respectively. Resistor R4, first terminal 116 is coupled to the zener diode anode 108 and to the silicon controlled rectifier gate 114. The resistor R4 second terminal 118 is connected to the silicon controlled rectifier cathode 112 and to the capacitor second terminal 76. The series combination of the D7 diode and limiting resistor R3 function in an equivalent manner to their function in the previously discussed embodiments.

During the starting mode, the threshold voltage triggered switching means comprising CR1, R4 and VR1, triggers in response to the quasi-exponentially increasing voltage on the capacitor C3 measured at the capacitor first terminal 74 with respect to the capacitor second terminal 76 exceeding the predetermined threshold established by the breakdown voltage of VR1. Current through VR1 passes through R4 raising the gate to cathode voltage of the silicon controled rectifier CR1 to the device firing level, typically between one and two volts. Once fired, CR1 switches to a conductive state thereby applying the C3 charge voltage to the transformer T2*c* primary winding between 66 and 68.

Transformer T2*c* operates to provide a stepped-up voltage between secondary terminals 70 and 72. The stepped-up voltage is selected to exceed the ionization voltage of lamp load 84. The invention high frequency ballast circuit next advances to the operate mode applying relatively high frequency, quasi-sinusoidal, current-limited voltage between the power oscillator first and second output terminals 40 and 42 to the fluorescent lamp load 84 through the transformer T2*c* secondary winding between its first and secondary terminals 70 and 72.

Referring again to FIG. 2, the power oscillator circuit means comprises a power oscillator circuit such as the circuit contained within phantom box 30 comprising: an inductor such as L1 having a first and second terminal 20, 22; a first and second resistor such as R1 and R2, each respective resistor having a respective first terminal 24, 28 and a respective second terminal 26, 30. The power oscillator circuit 30 further includes a first diode D2 having an anode 32 and a cathode 34; a first and second multiterminal semiconductor device such as Q1 and Q2, each respective multichannel device having a conductive channel such as the the path from the Q1 collector 36 to the Q1 emitter 41 and from the Q2 collector 43 to the Q2 emitter 46. The power oscillator circuit 30 also includes capacitor C2 having first terminal 50 and second terminal 52.

A transformer T1 is shown having a primary having first and second terminals 1 and 3 and center tap 2, a secondary having first and second terminals 7 and 8 and a signal control winding having first and second terminals 4 and 6 and center tap 5. The signal control winding supplies base drive current for transistors Q1 and Q2. The secondary terminals 7 and 8 are coupled to the power oscillator first and second output terminals. The power oscillator first resistor first terminal 24 is coupled to the high frequency ballast circuit first power input terminal 16 and to the inductor L1 first terminal 20. The power oscillator first diode cathode 34 is coupled to the power oscillator first resistor second terminal 26 and the power oscillator second resistor first terminal 28.

The power oscillator second resistor second terminal 30 is coupled to the signal control winding center-tap 5 and the transformer primary center-tap 8 is coupled to the inductor second terminal 22. The first multi-terminal semiconductor device conduction channel first terminal such as Q1 collector 36 is coupled to the transformer primary first terminal 1. The second multi-terminal semiconductor device conduction channel first terminal such as the Q2 collector 43 is coupled to the transformer primary second terminal 3. The first and second multi-terminal semiconductor devices conduction channel second terminals such as the Q1 and Q2 emitters 41 and 46 are coupled to the power oscillator first diode anode 32 and to the high frequency ballast circuit second power input terminal 18.

The first multi-terminal semiconductor control grid such as Q1 base 38 is coupled to the transformer signal control winding first terminal 4; the second multi-terminal semiconductor control grid such as Q2 base 44 is coupled to the signal control winding second terminal 6.

The power oscillator capacitor first terminal 50 is coupled to the transformer primary first terminal 1 and the power oscillator capacitor second terminal 52 is coupled to the transformer primary winding second terminal 3.

The phasing relationship between the transformer primary and the signal control winding is adapted to alternately drive each respective multi-terminal semiconductor device conduction channel into conduction; whereby, oscillation is continued.

In the embodiment of FIG. 2, the input voltage source of a first polarity comprises a voltage source such as that provided by the conventional bridge rectifier D1 and capacitor C1 powered by the ac mains, i.e. 120 V ac, 60 Hz power, having a positive polarity terminal such as 15 coupled to the high frequency ballast circuit first power input terminal 16 and a negative polarity terminal such as 13 coupled to the high frequency ballast circuit second power input terminal 18. FIG. 2 shows the first and second multi-terminal semiconductor devices Q1 and Q2 to be N-P-N transistors. Each transistor collector 36, 43 corresponding to a reapective multi-terminal semiconductor device conduction channel first terminal, each respective transistor emitter 41, 46 corresponding to its respective multi-terminal semiconductor device conduction channel second terminal and each respective transistor base 38, 44 corresponding to its respective control grid.

The preferred embodiment of FIG. 2 has power oscillator second and third diodes D4 and D6. Each respective second and third diode has a cathode and anode. Each respective power oscillator second and third diode is interposed between a respective first and second transistor emitter and the high frequency ballast circuit power input second terminal. Each respective anode terminal being coupled to a respective transistor emitter 41, 46 and each respective cathode terminal being coupled to the high frequency ballast circuit second power input terminal 18.

This embodiment permits current to pass on alternate cycles from each respective emitter 41, 46 through each respective second and third diode to the high frequency ballast circuit second power input terminal 18. Each respective second and third diode D4, D6 operates to protect each respective first and second transistor base-to-emitter junction from reverse drive voltage exceeding the reverse breakdown limit of each respective transistor base-to-emitter junction.

The power oscillator circuit 30 of the preferred embodiment of FIG. 2 further comprises fourth and fifth diode D3, D5. Each respective fourth and fifth diode D3, D5 has a cathode and anode terminal, and is interposed between a respective transistor collector 36, 43 and a respective transformer primary terminal. The fourth diode cathode is coupled to the first transistor collector 36. The fifth diode cathode is coupled to the second transistor collector 43. The fourth diode anode is coupled to the T1 primary first terminal 1 and the fifth diode anode is coupled to the transformer primary second terminal 3.

The fourth and fifth diodes D3 and D5 operate to permit current to pass on alternate cycles from each respective transformer primary terminal 1, 3 through a forward biased diode to a respective collector, the diodes operating to block current leaving each respective collector during short transition intervals.

In another alternative embodiment of the circuit of FIG. 2, the input voltage source of a first polarity further comprises a voltage source having a positive polarity terminal such as 15 coupled to the high frequency ballast circuit first power input terminal 16 and a negative polarity terminal 13 coupled to the high frequency ballast circuit second power input terminal 18, and wherein the first and second multi-terminal semiconductor devices such as Q1 and Q2 are N-channel field effect transistors, each respective field effect transistor having a drain a source and a gate, each respective field effect transistor drain corresponding to its respective multi-terminal semiconductor device conduction channel first terminal 36, 46 each respective field effect transistor source corresponding to its respective multi-terminal semiconductor device conduction channel second terminal 41, 46 and each respective field effect transistor gate corresponding to its respective control grid 38, 44.

CIRCUIT OPERATION

The circuit of FIG. 2 is adaptable for use with both high and low pressure sodium lamps. For the purpose of illustrating a particular preferred embodiment of the invention, it is convenient to assume that the circuit is designed to drive a lamp equivalent to the "LUMA LUX" LU-400 produced by Sylvania Division of GTE at Manchester, N.H. This lamp has a service rating of 400 watts. The starting mode of operation proceeds from the time power is applied to the circuit until the lamp ionizes. Ionization of the lamp typically commences when the voltage across the lamp load 84 exceeds 1000 volts peak-to-peak. Prior to ionizing, the lamp load presents a very high resistance to the driving circuit. After ionizing and entering the operating mode, the lamp load resistance drops, the lamp operating as a resistive clamp, the voltage across the lamp being limited to a peak value between 50 and 90 volts rms.

The power oscillator circuit 30 is typically designed to operate at between 15 and 25 kilohertz during the starting mode. The operating frequency increases to between 25 and 35 kilohertz after entering the operating mode. The circuit of FIG. 2 applies a relatively sinusoidal voltage across the secondary between terminals 70 and 72 of transformer **T2*a* in series with C3 in series with D7 in series with R3. During the starting mode, the voltage across C3 is sensed across SIDAC SD1 through the T2*a* primary 62. SD1 acts as an open preventing current from passing through it until the voltage across SD1** reaches the device firing threshold.

The voltage across C3 is adapted to rise on each alternate half-cycle of sinusoidal voltage applied at the power oscillator output terminals 40, 42. As the voltage at terminal 40 goes positive with respect to the voltage at 42, diode D7 is forward biased. Resistor R3 is selected to have a relatively large value and allows a small amount of rectified current from the cathode of diode D7 to pass through it to power oscillator second terminal 42. This small rectified current also passes through capacitor C3 thereby producing a dc voltage increase on C3 for each half cycle of applied sinusoidal voltage that exceeds the dc voltage charge on C3 and forward biases diode D7.

The dc voltage on capacitor C3 increases in an incremental quasi-exponential fashion in response to successive applied cycles of quasi-sinusoidal drive voltage. The rate of rise of the dc voltage across C3 is a predetermined function of the value of C3, the resistance of R3 and the peak amplitude of the applied sinusoidal voltage across the circuit branch comprising the **T2*a* primary 64, C3, D7 and R3 and the frequency of the power oscillator in the starting mode. Thus, if the frequency is increased or the peak swing of the applied voltage is increased or the value of R3 is increased or the the value of C3 is decreased, the dc voltage across C3** will increase more rapidly.

Operation of the circuit is taylored to the starting requirements of the lamp load selected. In a typical preferred embodiment adapted to drive a 400 watt high pressure sodium lamp such as the LU-400 mentioned above, R3 was selected to be 68K ohms, ½ watt; C3 was 0.47 uF, 250 V; and the SIDAC SD1 was a TECCOR Electronics Inc. model K2400E, having a 1.0 Amp On State RMS current rating with a 220 to 250 V ac breakover voltage. In operation, the circuit reached the breakover voltage of the SD1 device and attempted to restart approximately once per second.

The circuit having this design also used a transformer T1 having a 32 turn center taped primary and a 16 turn secondary one a ferrite E-I core by Stackpole. The E-piece selected was a 50-566 and the I-piece used was a 50-567. Each leg was gaped to 0.010 inches. The wire used was number 12 AWG for both windings. The inductor L1 used 100 turns on an E168-26A core. Each leg was gaped to 0.010 inches. The transformer T2 had a 30 turn primary 64 and a 1 turn secondary 62 on an E—E 50-897 core by Stackpole. Each leg was gaped to 0.075 inches. The transistors Q1 and Q2 had maximum collector current ratings of 8 amps and a Vceo rating of 400 V. The C2 capacitor was a 1600 V, 0.015 uF low ESR device. Diodes D3, D4, D5 and D6 were 5 amp fast recovery devices with a sutable reverse voltage rating.

With the lamp load removed or disabled, such as commonly occurs when attempting to restart a high pressure sodium vapor lamp that has not had time to cool, the circuit continues to fire repeatedly with approximately a one second period. Once the lamp cools sufficiently to lower its ionization voltage to that achieved by the particular circuit used, the bulb re-ionizes and its continued operation is supported in the operate mode. The ability of the invention circuit to automatically re-enter the starting mode upon loss of the lamp load is a desirable feature from the standpoint of public safety. An unanticipated interruption of electrical service to users using a lamp-load of the high pressure sodium lamp type will typically cause the lamp to extinguish. A high pressure sodium lamp must be allowed to cool before its ionization voltage falls to an achievable firing level. The invention circuits patiently awaits this event, reionizing the lamp at the earliest moment re-ionization becomes possible.

It is believed that the foregoing description of a preferred embodiment of my invention is presented in sufficient detail as will enable one skilled in the art to make and use same without undue experimentation. However, in so doing, it is not my intent to restrict or limit my invention to those details. Other elements may be substituted and improvements or modifications may be made to the foregoing. These substituted, added elements or improvements when combined will become apparent, to those skilled in the art, upon reading this specification as combinations expressing or containing the teachings presented in this specification. Accordingly, it is respectfully requested that our invention be broadly construed within the full spirit and scope of the appended claims.

We claim:

1. A high frequency ballast circuit having a first and second power input terminals and first and second power output terminals, said high frequency ballast circuit being powered by a filtered dc input voltage source having a positive polarity terminal coupled to the first power input terminal and a negative polarity terminal coupled to the second power input terminal, said high frequency ballast circuit having a starting mode and operating mode for starting and operating a fluorescent lamp load connected between said first and second power output terminals, said starting mode being characterized by said high frequency ballast circuit operation before ionization of said fluorescent lamp load and said operating mode being characterized by said high frequency ballast circuit operation subsequent to ionization of said fluorescent lamp load, said high frequency ballast circuit comprising:

a power oscillator circuit having;

an inductor; said inductor having a first and second terminal, a first and second resistor; each resistor having a respective first and second terminal, a first diode having an anode and a cathode, a first and second NPN transistor, each transistor having a having a collector, an emitter and a base, a capacitor having a first and second terminal and a transformer having a primary, a secondary, and a signal control winding, said primary having a first and second terminal and a center-tap, said secondary having at least a first and second terminal, said signal control winding having a first and second terminal and a center-tap, said power oscillator first resistor first terminal being coupled to said high frequency ballast circuit first power input terminal and to said inductor first terminal, said power oscillator first diode cathode being coupled to said power oscillator first resistor second terminal and said power oscillator second resistor first terminal, said power oscillator second resistor second terminal being coupled to said signal control winding center-tap, said transformer primary center-tap being coupled to said inductor second terminal, said first transistor collector being coupled to said transformer primary first terminal, said second transistor collector being coupled to said transformer primary second terminal, said first and second transistor emitters being coupled to said power oscillator first diode anode and to said high frequency ballast circuit second power input terminal, said first transistor base being coupled to said signal control winding first terminal, said second transistor base being coupled to said signal control winding second terminal, said power oscillator capacitor first terminal being coupled to said transformer primary first terminal, said power oscillator capacitor second terminal being coupled to said transformer primary second terminal, the phasing relationship between said transformer primary and said signal control winding being characterized to alternately drive each respective transistor into conduction;

said transformer secondary second terminal being coupled to said high frequency balast circuit second output terminals, a starting and current limiting circuit means for interposing a periodic voltage pulse between said transformer secondary first terminal and said high frequency ballast circuit first power output terminal, said periodic voltage pulse having an amplitude characterized to exceed the ionization potential of said lamp load during said starting mode, said starting and current limiting circuit means additionally providing a predetermined reactance between said first power oscillator output terminal and said high frequency ballast circuit first power output terminal to limit current through said fluorescent lamp load.

2. The combination of claim 1 wherein said starting and current limiting circuit means is further adapted to interrupt said periodic voltage pulse during said operating mode.

3. The combination of claim 1 wherein said starting and current limiting circuit means further comprises:

a starting circuit transformer having a primary and a secondary winding, said primary winding having at least first and second terminal, and said secondary having at least a first and second terminal, said transformer secondary winding first terminal being coupled to said power oscillator circuit transformer secondary first terminal and said starting circuit secondary winding second terminal being coupled to said first power output terminal, said starting circuit transformer secondary winding having a greater number of turns than said transformer primary winding and a secondary self inductance selected to limit said fluorescent lamp load current to a predetermined limit, a capacitor having a first and second terminal, a resistor having a first and second terminal, a diode having an anode terminal and a cathode terminal, said capacitor, resistor and diode being coupled to form a first series circuit between said first and second power output terminals, said first series circuit having said diode rectify a portion of said relatively high frequency quasi-sinusoidal, current-limited voltage providing rectified current through said diode, said capacitor, and said resistor, said rectified current producing a positive quasi-exponentially increasing voltage on said capacitor first terminal with respect to said capacitor second terminal during said starting mode, a threshold voltage triggered switching means having at least a first and second switch terminal for triggering and switching from a non-conductive first state to a conductive second state establishing a conductive path between said first and second switch terminal in response to the positive quasi-exponentially increasing voltage on said capacitor first terminal with respect to said capacitor second terminal during said starting mode exceeding a predetermined threshold limit, said threshold voltage triggered switching means being further adapted to return to said first state in response to said the voltage between said first and second switch terminals dropping below a second predetermined threshold limit, said starting circuit transformer primary winding being coupled to form a second series circuit between said first and second switch terminals, said second series circuit being coupled in shunt with said capacitor;

whereby, during said starting mode, said threshold voltage triggered switching means triggers in response to the positive quasi-exponentially increasing voltage on said capacitor first terminal with respect to said capacitor second terminal exceeding said predetermined threshold voltage, said triggered switching means applying the voltage across said capacitor to said starting circuit transformer primary winding, said capacitor discharging through said transformer primary winding, said transformer operating to provide a stepped-up voltage across said transformer secondary terminals, said stepped-up voltage being selected to exceed the ionization voltage of said fluorescent lamp load, said high frequency ballast circuit thereafter advancing to said operating mode applying the relatively high frequency, quasi-sinusoidal, current-limited voltage source to said fluorescent lamp load through said transformer secondary winding to operate said fluorescent lamp load.

4. The combination of claim 3 wherein said starting circuit transformer primary and secondary windings further comprise an autotransformer having a single winding with at least a first, second and third terminal, said first and third terminals being at opposing ends of said single winding, said auto-transformer secondary winding being formed by said single winding between said auto-transformer first and third terminal, said transformer first terminal being coupled to said power oscillator transformer secondary first terminal, said auto-transformer secondary winding third terminal being coupled to said first power output terminal, said auto-transformer second terminal being a tap terminal between said first and third terminals, that portion of said single winding between said second and third transformer terminals forming said auto-transformer primary, said capacitor first terminal coupled to said first power output terminal, said resistor being coupled in series with said diode to forming a third series circuit having a first and second terminal, said capacitor second terminal being coupled to said third series circuit first terminal, said third series circuit second terminal being coupled to said second power output terminal, said first switch terminal being coupled to said capacitor second terminal and said second switch terminal being coupled to said auto-transformer second terminal;

whereby, during said starting mode, said threshold voltage triggered switching means triggers in response to the positive quasi-exponentially increasing voltage on said capacitor first terminal with respect to said capacitor second terminal exceeding said predetermined threshold voltage, said triggered switching means applying the voltage across said capacitor to said auto-transformer primary winding, said capacitor discharging through said auto-transformer primary winding, said auto-transformer operating to probvide a stepped-up voltage across said auto-transformer secondary terminals, said stepped-up voltage being selected to exceed the ionization voltage of said fluorescent lamp load, said high frequency ballast circuit thereafter advancing to said operating mode applying the relatively high frequency, quasi-sinusoidal, current-limited voltage source to said fluorescent lamp load through said auto-transformer secondary winding to operate said fluorescent lamp load.

5. The combination of claim 3 wherein said a threshold voltage triggered switching means further comprises a SIDAC.

6. The combination of claim 4 wherein said a threshold voltage triggered switching means further comprises a SIDAC, said SIDAC having a breakover voltage having a magnitude less than the peak magnitude of the exponentially increasing voltage on said threshold voltage switching means capacitor subsequent to entering the operate mode.

7. The combination of claim 3 wherein said a threshold voltage triggered switching means further comprises:

a zener diode having a cathode and an anode, said cathode being coupled to said high frequency ballast circuit first power output terminal, a silicon controlled rectifier having an anode, a cathode and a gate, said anode being coupled to said transformer primary first terminal, said transformer primary second terminal being coupled to said high frequency ballast circuit first power output terminal, a gate-to-cathode resistor having a first and second terminal, said gate-to-cathode resistor first terminal being coupled to said zener diode anode and to said silicon controlled rectifier gate, said gate-to-cathode resistor second terminal being connected to said silicon controlled rectifier cathode, said capacitor second terminal and said diode anode, whereby, during said starting mode, said threshold voltage triggered switching means triggers in response to the positive quasi-exponentially increasing voltage on said capacitor first terminal with respect to said capacitor second terminal exceeding the predetermined threshold voltage established by the breakdown voltage of said zener, current through said zener raising the gate to cathode voltage of said silicon controlled rectifier to a triggering level, said silicon controlled rectifier switching to a conductive state thereby applying the voltage across said capacitor to said transformer primary winding, said capacitor discharging through said transformer primary winding, said transformer operating to provide a stepped-up voltage across said transformer secondary terminals, said stepped-up voltage being selected to exceed the ionization voltage of said fluorescent lamp load, said high frequency ballast circuit thereafter advancing to said operating mode applying the relatively high frequency, quasi-sinusoidal, current-limited voltage source to said fluorescent lamp load through said transformer secondary winding to operate said fluorescent lamp load.

8. The combination of claim 1 wherein said power oscillator circuit further comprises:

power oscillator second and third diodes, each respective second and third diode having a cathode and anode terminal, each respective power oscillator second and third diode being interposed between a respective first and second transistor emitter and said high frequency ballast circuit power input second terminal, each respective anode terminal being coupled to a respective transistor emitter, and each respective cathode terminal being coupled to said high frequency ballast circuit power input second terminal, each respective anode terminal being coupled to a respective transistor emitter, and each respective cathode terminal being coupled to said high frequency ballast circuit second power input terminal;

whereby, current is permitted to pass on alternate cycles from each respective emitter through each respective second and third diode to said high frequency ballast circuit second power input terminal, each respective second and third diode operating to protect each respective first and second transistor base-to-emitter junction from reverse drive voltage exceeding the reverse breakdown limit of each respective transistor base-to-emitter junction.

9. The combination of claim 1 wherein said power oscillator circuit further comprises a fourth a fifth diode, each respective diode having a cathode and anode terminal, each respective fourth and fifth diode being interposed between a respective transistor collector and a respective transformer primary terminal, each respective fourth and fifth diode cathode being coupled to a respective transistor collector and each respective fourth and fifth diode anode being coupled to a respective transformer primary first and second terminal;

whereby, current is permitted to pass on alternate cycles from each respective transformer primary terminal through a forward biased diode to a respective collector, said diodes operating to block current leaving each respective collector.

10. The combination of claim 1 wherein said first and second transistors are N-channel field effect transistor, each respective field effect transistor having a drain, a source and a gate, each respective field effect transistor drain corresponding to its respective collector, each respective field effect transistor source corresponding to its respective emitter and each respective field effect transistor gate corresponding to its respective base.

11. A high frequency ballast circuit having a first and second power input terminals and first and second power output terminals, said high frequency ballast circuit being powered by a filtered dc input voltage source having a positive polarity terminal coupled to the first power input terminal and a negative polarity terminal coupled to the second power input terminal, said high frequency ballast circuit having a starting mode and operating mode for starting and operating a fluorescent lamp load connected between said first and second power output terminals, said starting mode being characterized by said high frequency ballast circuit operation before ionization of said fluorescent lamp load and said operating mode being characterized by said high frequency ballast circuit operation subsequent to ionization of said fluorescent lamp load, said high frequency ballast circuit comprising:

a power oscillator circuit having;

an inductor; said inductor having a first and second terminal, a first and second resistor; each resistor having a respective first and second terminal, a first diode having an anode and a cathode, a first and second NPN transistor, each transistor having a having a collector, an emitter and a base, a capacitor having a first and second terminal and a transformer having a primary, a secondary, and a signal control winding, said primary having a first and second terminal and a center-tap, said secondary having at least a first and second terminal, said signal control winding having a first and second terminal and a center-tap, said power oscillator first resistor first terminal being coupled to said high frequency ballast circuit first power input terminal and to said inductor first terminal, said power oscillator first diode cathode being coupled to said power oscillator first resistor second terminal and said power oscillator second resistor first terminal, said power oscillator second resistor second terminal being coupled to said signal control winding center-tap, said transformer primary center-tap being coupled to said inductor second terminal, said first transistor collector being coupled to said transformer primary first terminal, said second transistor collector being coupled to said transformer primary second terminal, said first and second transistor emitters being coupled to said power oscillator first diode anode and to said high frequency ballast circuit second power input terminal, said first transistor base being coupled to said signal control winding first terminal, said second transistor base being coupled to said signal control winding second terminal, said power oscillator capacitor first terminal being coupled to said transformer primary first terminal, said power oscillator capacitor second terminal being coupled to said transformer primary second terminal, the phasing relationship between said transformer primary and said signal control winding being characterized to alternately drive each respective transistor into conduction;

said transformer secondary second terminal being coupled to said high frequency balast circuit second output terminals, a starting and current limiting circuit means for interposing a periodic voltage pulse between said transformer secondary first terminal and said high frequency ballast circuit first power output terminal, said periodic voltage pulse having an amplitude characterized to exceed the ionization potential of said lamp load during said starting mode, said starting and current limiting circuit means additionally providing a predetermined reactance between said first power oscillator output terminal and said high frequency ballast circuit first power output terminal to limit current through said fluorescent lamp load;

said starting and current limiting circuit means further comprising: a transformer having a primary winding and a secondary winding, said primary winding having at least a first and second terminal, and said secondary winding having at least a first and second terminal, said transformer secondary winding first terminal being coupled to said power oscillator first output terminal and said secondary winding second terminal being coupled to said high frequency ballast circuit first power output terminal, said transformer secondary winding having a greater number of turns than said transformer primary winding and a secondary self inductance selected to limit said fluorescent lamp load current to a predetermined limit, a capacitor having a first and second terminal, a resistor having a first and second terminal, a diode having an anode terminal and a cathode terminal, said capacitor, resistor and diode being coupled to form a first series circuit between said high frequency ballast circuit first and second power output terminals, said first series circuit having said diode rectify a portion of said relatively high frequency quasi-sinusoidal, current-limited voltage providing rectified current through said diode, said capacitor, and said resistor, said rectified current producing a positive quasi-exponentially increasing voltage on said capacitor first terminal with respect to said capacitor second terminal during said starting mode, a threshold voltage triggered switching means having at least a first and second switch terminal for triggering and switching from a non-conductive first state to a conductive second state establishing a conductive path between said first and second switch terminal in response to the positive quasi-exponentially increasing voltage on said capacitor first terminal with respect to said capacitor second terminal during said starting mode exceeding a predetermined threshold limit, said threshold voltage triggered switching means being further adapted to return to said first state in response to said the voltage between said first and second switch terminals dropping below a second predetermined threshold limit, said transformer primary winding being coupled to form a second series circuit between said first and second switch terminals, said second series circuit being coupled in shunt with said capacitor;

whereby, during said starting mode, said threshold voltage triggered switching means triggers in response to the positive quasi-exponentially increasing voltage on said capacitor first terminal with respect to said capacitor second terminal exceeding said predetermined threshold voltage, said triggered switching means applying the voltage across said capacitor to said transformer primary winding, said capacitor discharging through said transformer primary winding, said transformer operating to provide a stepped-up voltage across said transformer secondary terminals, said stepped-up voltage being selected to exceed the ionization voltage of said fluorescent lamp load, said high frequency ballast circuit thereafter advancing to said operating mode applying the relatively high frequency, quasi-sinusoidal, current-limited voltage source to said fluorescent lamp load through said transformer secondary winding to operate said fluorescent lamp load.

12. The combination of claim 11 wherein said transformer primary and secondary windings further comprise an auto-transformer having a single winding with at least a first, second and third terminal, said first and third terminals being at opposing ends of said single winding, said transformer secondary winding being formed by said single winding between said transformer first and third terminal, said transformer first terminal being coupled to said power oscillator transformer secondary first terminal, said secondary winding third terminal being coupled to said high frequency ballast circuit first power output terminal, said transformer second terminal being a tap terminal between said first and third terminals, that portion of said single winding between said second and third transformer terminals forming said transformer primary, said first series circuit having said capacitor first terminal coupled to high frequency ballast circuit first power output terminal, said series combination of said resistor and said diode forming a third series circuit having a first and second terminal, said capacitor second terminal being coupled to said third series circuit first terminal, said third series circuit second terminal being coupled to said high frequency ballast circuits first power output terminal, said first switch terminal being coupled to said capacitor second terminal and said second switch terminal being coupled to said transformer second terminal;

whereby, during said starting mode, said threshold voltage triggered switching means triggers in response to the positive quasi-exponentially increasing voltage on said capacitor first terminal with respect to said capacitor second terminal exceeding said predetermined threshold voltage, said triggered switching means applying the voltage across said capaeitor to said transformer primary winding, said capacitor discharging through said transformer primary winding, said transformer operating to provide a stepped-up voltage across said transformer secondary terminals, said stepped-up voltage being selected to exceed the ionization voltage of said fluorescent lamp load, said high frequency ballast circuit thereafter advancing to said operating mode applying the relatively high frequency, quasi-sinusoidal, current-limited voltage source to said fluorescent lamp load through said transformer secondary winding to operate said fluorescent lamp load.

13. The combination of claim 11 wherein said a threshold voltage triggered switching means further comprises a SIDAC.

14. The combination of claim 12 wherein said a threshold voltage triggered switching means further comprises a SIDAC, said SIDAC having a breakover voltage having a magnitude less than the peak magnitude of the exponentially increasing voltage on said threshold voltage switching means capacitor subsequent to entering the operate mode.

15. The combination of claim 11 wherein said a threshold voltage triggered switching means further comprises:

a zener diode having a cathode and an anode, said cathode being coupled to said high frequency ballast circuit first power output terminal, a silicon controlled rectifier having an anode, a cathode and a gate, said anode being coupled to said transformer primary first terminal, said transformer primary second terminal being coupled to said high frequency ballast circuit first power output terminal, a gate-to-cathode resistor having a first and second terminal, said gate-to-cathode resistor first terminal being coupled to said zener diode anode and to said silicon controlled rectifier gate, said gate-to-cathode resistor second terminal being connected to said silicon controlled rectifier cathode, said capacitor second terminal and said diode anode, whereby, during said starting mode, said threshold voltage triggered switching means triggers in response to the positive quasi-exponentially increasing voltage on said capacitor first terminal with respect to said capacitor second terminal exceeding the predetermined threshold voltage established by the breakdown voltage of said zener, current through said zener raising the gate to cathode voltage of said silicon controlled rectifier to a triggering level, said silicon controlled rectifier switching to a conductive state thereby applying the voltage across said capacitor to said transformer primary winding, said capacitor discharging through said transformer primary winding, said transformer operating to provide a stepped-up voltage across said transformer secondary terminals, said stepped-up voltage being selected to exceed the ionization voltage of said fluorescent lamp load, said high frequency ballast circuit thereafter advancing to said operating mode applying the relatively high frequency, quasi-sinusoidal, current-limited voltage source to said fluorescent lamp load through said transformer secondary winding to operate said fluorescent lamp load.

* * * * *